US006387237B1

(12) United States Patent
Homley et al.

(10) Patent No.: US 6,387,237 B1
(45) Date of Patent: May 14, 2002

(54) CATHODE COLLECTOR BAR WITH SPACER FOR IMPROVED HEAT BALANCE AND METHOD

(75) Inventors: Graham E. Homley, Export, PA (US); Claude Gauthier, Sainte-Foy; Louise Pearson, Neuville, both of (CA)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/546,273

(22) Filed: Apr. 10, 2000

Related U.S. Application Data

(63) Continuation-in-part of application No. 09/416,767, filed on Oct. 13, 1999, now Pat. No. 6,231,745.

(51) Int. Cl.[7] ..... C25C 3/06; C25C 3/08

(52) U.S. Cl. ..... 205/372; 204/243.1; 204/247

(58) Field of Search ..... 204/243.1, 247.1, 204/247.5, 247; 205/372

(56) References Cited

U.S. PATENT DOCUMENTS

| | | | | |
|---|---|---|---|---|
| 2,846,388 A | * | 8/1958 | Morel | 204/243.1 |
| 3,499,831 A | | 3/1970 | McMinn et al. | 204/243 |
| 3,551,319 A | | 12/1970 | Elliott | 204/243 |
| 4,795,540 A | | 1/1989 | Townsend | 204/243 R |
| 5,538,607 A | | 7/1996 | Pate | 204/280 |
| 5,597,461 A | | 1/1997 | Pate | 204/286 |
| 5,855,758 A | | 1/1999 | Mitchell et al. | 205/372 |
| 5,976,333 A | | 11/1999 | Pate | 204/279 |

* cited by examiner

*Primary Examiner*—Donald R. Valentine
(74) *Attorney, Agent, or Firm*—Glenn E. Klepac

(57) ABSTRACT

An electrolytic cell for aluminum production, including a cell wall, a bus bar, a carbonaceous cathode block, and a collector bar connecting the bus bar with the cathode block. The collector bar comprises a ferrous metal body including a solid spacer and a sheath defining a cavity containing a copper insert. The spacer has an external end portion connected with the bus bar and an internal end portion that is preferably spaced inwardly of the cell wall. The spacer separates the copper insert from the bus bar, thereby reducing heat loss from the cell.

17 Claims, 5 Drawing Sheets

CATHODE COLLECTOR BAR WITH SPACER FOR IMPROVED HEAT BALANCE AND METHOD

PENDING RELATED APPLICATION

This Application is a continuation-in-part of U.S. Ser. No. 09/416,767, filed Oct. 13, 1999, now U.S. Pat. No. 6,231,745, and entitled "Cathode Collector Bar".

BACKGROUND OF THE INVENTION

1. Technical Field

This invention relates to electrolytic cells. In one aspect, this invention relates to cathode collector bars of electrolytic reduction smelting cells used in the production of aluminum.

2. Background

Aluminum is produced by an electrolytic reduction of alumina in an electrolyte. The aluminum produced commercially by the electrolytic reduction of alumina is referred to as primary aluminum.

Electrolysis involves an electrochemical oxidation-reduction associated with the decomposition of a compound. An electrical current passes between two electrodes and through molten $Na_3AlF_6$ cryolite bath containing dissolved alumina. Cryolite electrolyte is composed of a molten $Na_3AlF_6$ cryolite bath containing alumina and other materials, e.g., such as fluorspar, dissolved in the electrolyte. A metallic constituent of the compound is reduced together with a correspondent oxidation reaction.

Electrical current is passed between the electrodes from an anode to a cathode to provide electrons at a requisite electromotive force to reduce the metallic constituent which usually is the desired electrolytic product, such as in the electrolytic smelting of aluminum. The electrical energy expended to produce the desired reaction depends on the nature of the compound and the composition of the electrolyte.

Hall-Heroult aluminum reduction cells are operated at low voltages (e.g. 4–5 volts) and high electrical currents (e.g. 70,000–325,000 amps). The high electrical current enters the reduction cell through the anode structure and then passes through the cryolite bath, through a molten aluminum metal pad, and then enters a carbon cathode block. The electrical current is carried out of the cell by cathode collector bars.

As the electrolyte is traversed by electric current, alumina is reduced electrolytically to aluminum at the cathode, and carbon is oxidized largely to carbon dioxide at the anode. The aluminum, thus produced, accumulates at the molten aluminum pad and is tapped off periodically. Commercial aluminum reduction cells are operated by maintaining a minimum depth of liquid aluminum in the cell, the surface of which serves as the actual cathode. The minimum aluminum depth is about 2 inches and may be 20 inches.

The alumina-cryolite bath is maintained on top of the molten aluminum metal pad at a set depth. The current passes through the cryolite bath at a voltage loss directly proportional to the length of the current path, i.e., the interpolar distance gap between the anode and molten aluminum pad. A typical voltage loss is about 1 volt per inch. Any increase of the anode to cathode spacing restricts the maximum power efficiency and limits the efficiency of the electrolytic cell operation.

Much of the voltage drop through an electrolytic cell occurs in the electrolyte and is attributable to electrical resistance of the electrolyte, or electrolytic bath, across the anode-cathode distance. The bath electrical resistance or voltage drop in conventional Hall-Heroult cells for the electrolytic reduction of alumina dissolved in a molten cryolite bath includes a decomposition potential, i.e., energy used in producing aluminum, and an additional voltage attributable to heat energy generated in the inter-electrode spacing by the bath resistance. This latter heat energy makes up 35 to 45 percent of the total voltage drop across the cell, and in comparative measure, as much as twice the voltage drop attributable to decomposition potential.

An adverse result from reducing anode-cathode distance is a significant reduction in current efficiency of the cell when the metal produced by electrolysis at the cathode is oxidized by contact with the anode product. For example, in the electrolysis of alumina dissolved in cryolite, aluminum metal produced at the cathode can be oxidized readily back to alumina or aluminum salt by a close proximity to the anodically produced carbon oxide. A reduction in the anode-cathode separation distance provides more contact between anode product and cathode product and significantly accelerates the reoxidation or "back reaction" of reduced metal, thereby decreasing current efficiency.

The high amperage electrical current passing through the electrolytic cell produces powerful magnetic fields that induce circulation in the molten aluminum pad leading to problems such as reduced electrical efficiency and "back reaction" of the molten aluminum with the electrolyte. The magnetic fields also vary the depths in unequal distance between the molten aluminum pad and the anode. The motion of the metal pad increases, sometimes violently stirring the molten pad and generating vortices, and causing localized electrical shorting.

Metal pad depth variations restrict the reduction of the anode to cathode gap and produce a loss in current efficiency. Power is lost to the electrolyte interposed between the anode and cathode blocks. Movement of the molten aluminum metal pad also contributes to uneven wear on the carbon cathode blocks and can accelerate cell failure.

Metal pad turbulence also increases the "back reaction," or reoxidation, of cathodic products, thereby lowering cell efficiency. Metal pad turbulence accelerates distortion and degradation of the cathode bottom liner through attrition and penetration of the cryolite.

In the conventional cathode today, steel cathode collector bars extend from the external bus bars through each side of the electrolytic cell into the carbon cathode blocks. The steel cathode collector bars are attached to the cathode blocks with cast iron, carbon glue, or rammed carbonaceous paste to facilitate electrical contact between the carbon cathode blocks and the steel cathode collector bars.

The flow of electrical current through the aluminum pad and the carbon cathode follows the path of least resistance. The electrical resistance in a conventional cathode collector bar is proportional to the length of the current path from the point the electric current enters the cathode collector bar to the nearest external bus. The lower resistance of the current path starting at points on the cathode collector bar closer to the external bus causes the flow of current through the molten aluminum pad and carbon cathode blocks to be skewed in that direction. The horizontal components of the flow of electric current interact with the vertical component of the magnetic field, adversely affecting efficient cell operation.

INTRODUCTION TO THE INVENTION

Existing Hall-Heroult cell cathode collector bar technology is limited to rolled or cast mild steel sections. The high temperature and aggressive chemical nature of the electrolyte combine to create a harsh operating environment. The high melting point and low cost of steel offset its relatively poor electrical conductivity. In comparison, potential metallic alternatives such as copper or silver have high electrical conductivity but low melting points and high cost. Copper is used in the apparatus and process of the present invention because it provides a preferred combination of electrical conductivity, melting point, and cost. Other high conductivity materials could be used based on their combinations of electrical conductivity, melting point, and cost relative to the aluminum smelting process.

The electrical conductivity of steel is so poor relative to the aluminum metal pad that the outer third of the collector bar, nearest the side of the pot, carries the majority of the load, thereby creating a very uneven cathode current distribution within each cathode block. Because of the chemical properties, physical properties, and, in particular, the electrical properties of conventional anthracite cathode blocks, the poor electrical conductivity of steel had not presented a severe process limitation until recently.

Conventional cathodes contained either 100% Gas Calcined Anthracite (GCA) or 100% Electrically Calcined Anthracite (ECA). These cathode blocks had poor thermal shock resistance. These cathode blocks swelled badly under electrolysis conditions, i.e., under the influence of cathodic current, reduced sodium, and dissolved aluminum. These cathode blocks had poor electrical conductivity (relative to graphite). In their favor, these cathode blocks had low erosion or wear rates (relative to graphite).

To overcome the shortcomings of 100% anthracite cathodes, cathode manufacturers added an increasing proportion of graphite to the raw cathode block mix. A minimum of 30% graphite seems to be sufficient to avoid thermal shock cracking and to provide reasonable electrical properties and sodium resistance in most instances. Further additions up to 100% graphite aggregate or 100% coke aggregate graphitized at 2,000–3,000° C. provide preferred operating and productivity conditions.

As the graphite content or degree of graphitization increases, the rate increases at which the cathode blocks erode or are worn away.

In pursuit of economies of scale, aluminum smelting pots have increased in size as the operating amperage has increased. As the operating amperage has been increased, the percentage of graphite in cathodes has increased to take advantage of improved electrical properties and maximize production rates. In many cases, this has resulted in a move to graphitized cathode blocks.

The operation of the pot is most typically terminated when the aluminum metal is contaminated by contact with the steel collector bars. This can happen when the cathode to seam mix joints leak, when the cathode blocks crack or break because of thermal or chemical effects or the combined thermochemical effects, or when erosion of the top surface of the block exposes the collector bar. In the application of higher graphite and graphitized cathode blocks, the dominant failure mode is due to highly localized erosion of the cathode surface, eventually exposing the collector bar to the aluminum metal.

In a number of pot designs, higher peak erosion rates have been observed for these higher graphite content blocks than for 30% graphite/ECA blocks or 100% ECA blocks. Operating performance is therefore traded for operating life.

There is a link between the rapid wear rate, the location of the area of maximum wear, and the non-uniformity of the cathode current distribution. The higher graphite content and graphitized cathodes are more electrically conductive and as a result have a much more non-uniform cathode current distribution pattern and hence higher wear rate.

Accordingly, there is a need to develop and provide a more even cathode current distribution so that the cathode wear rate will be decreased, the pot life will be increased, and the operating benefits of the higher graphite and graphitized cathode blocks can be realized.

A related objective of the present invention is to provide an electrolytic reduction cell apparatus and method utilizing a novel cathode collector bar, including a solid, ferrous metal spacer for maintaining a controlled heat balance in the pot.

These and other objects of the present invention will become more apparent from reference to the following detailed description of our invention.

SUMMARY OF THE INVENTION

In accordance with the present invention, there is provided an apparatus and method for production of aluminum. The apparatus of the invention comprises an electrolytic cell for reducing alumina dissolved in a molten salt bath to aluminum metal. An electric current passes between an anode and a cathode through the molten bath, producing aluminum metal adjacent the cathode.

The electrolytic cell has cell walls including a first cell wall and a second cell wall, an anode, a carbonaceous cathode block separated from the anode, a bus bar external to the first cell wall, and a collector bar connecting the bus bar with the cathode block. The cathode block preferably defines a slot in which the collector bar is seated. The cell walls define a chamber containing a molten salt bath.

The collector bar includes a ferrous metal body and a copper insert. As used herein, the term "ferrous metal" refers to iron and steel, including mild steel, low carbon steel, and stainless steel. The term "copper" includes alloys of copper with various other metals including silver. For practice of the present invention we prefer relatively pure forms of copper containing at least 99 wt. % copper because of their excellent electrical conductivity.

The collector bar has a ferrous metal body comprising a solid, ferrous metal spacer having an external end portion connected with the bus bar and an internal end portion spaced inwardly of the first cell wall. The spacer improves heat balance in the cell by preventing excessive heat transfer between the copper insert and the bus bar. The ferrous metal body also includes a ferrous metal sheath integral with the spacer and defining a cavity containing the copper insert. The cavity extends between an external end adjacent the internal end portion of the spacer, and an internal opening. The cavity and the copper insert may be polygonal or circular in transverse cross-section. We prefer a cylindrical copper insert inside a cavity having a circular transverse cross-section.

The slot in the cathode block preferably contains means for joining the collector bar to the cathode block, preferably an electrically conductive material. This material may be cast iron, carbonaceous glue or rammed carbonaceous paste and is preferably cast iron.

The cathode assembly of the present invention is useful for producing aluminum by electrolysis. The cathode assembly is spaced downwardly of an anode in a chamber containing a molten salt bath. An electric current passes from the anode to the cathode assembly, reducing alumina dissolved in the molten salt bath to aluminum deposited in a pad above the cathode block. The copper insert in the collector bar distributes electric current more evenly than in prior art cells having collector bars containing only steel or other ferrous metal. The ferrous metal spacer in the collector bar body reduces heat losses, compared with collector bars having a copper insert connected directly to the bus bar.

DETAILED DESCRIPTION

The apparatus and method of the present invention provide a novel collector bar that minimizes horizontal electrical currents while controlling heat losses. The novel collector bar of our invention may be incorporated into existing aluminum production cells having standard carbon cathode blocks.

Figure 1:
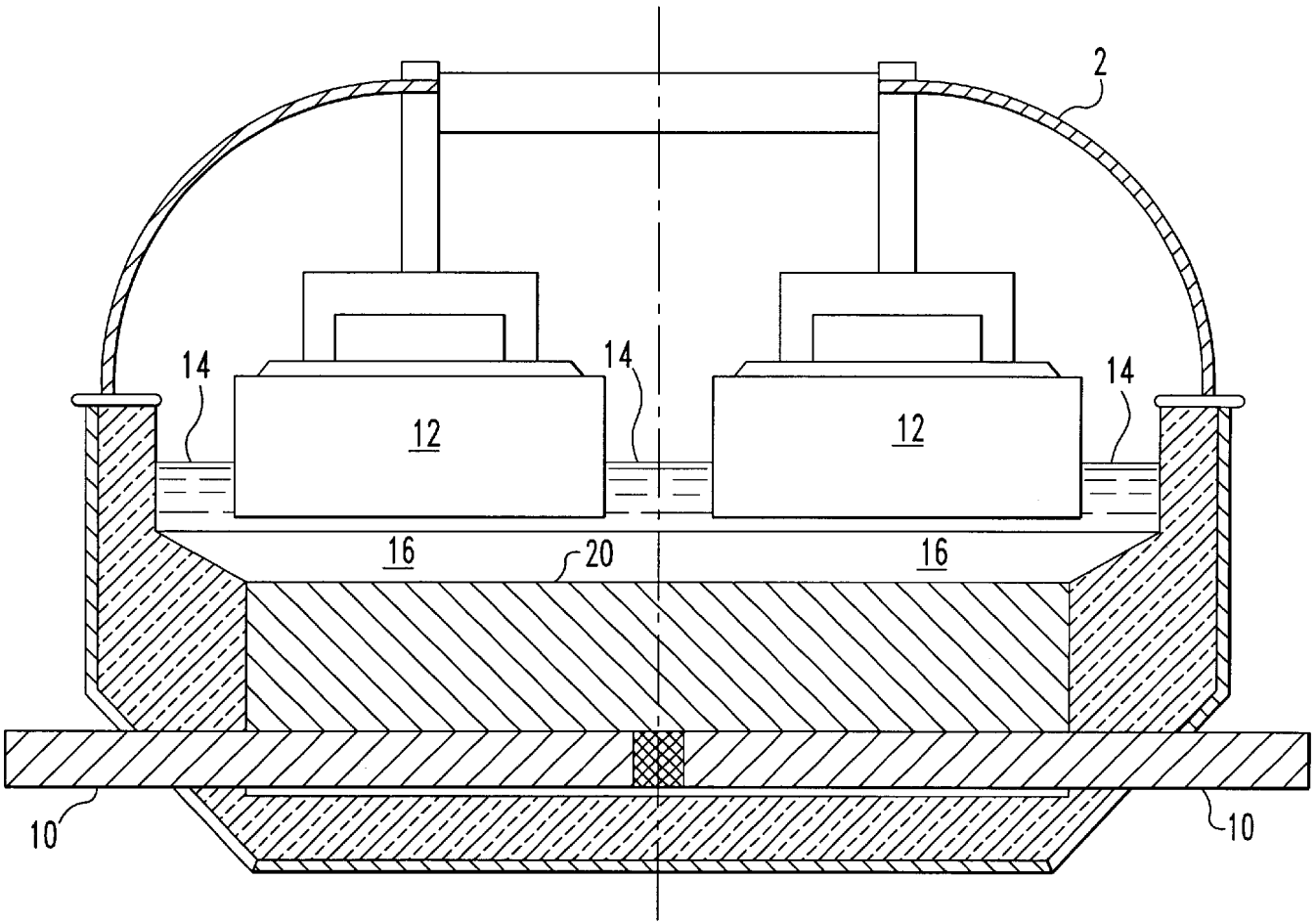
FIG. 1 PRIOR ART
FIG. 1 is a schematic cross-sectional view of a prior art electrolytic cell for aluminum production.
Figure 5:
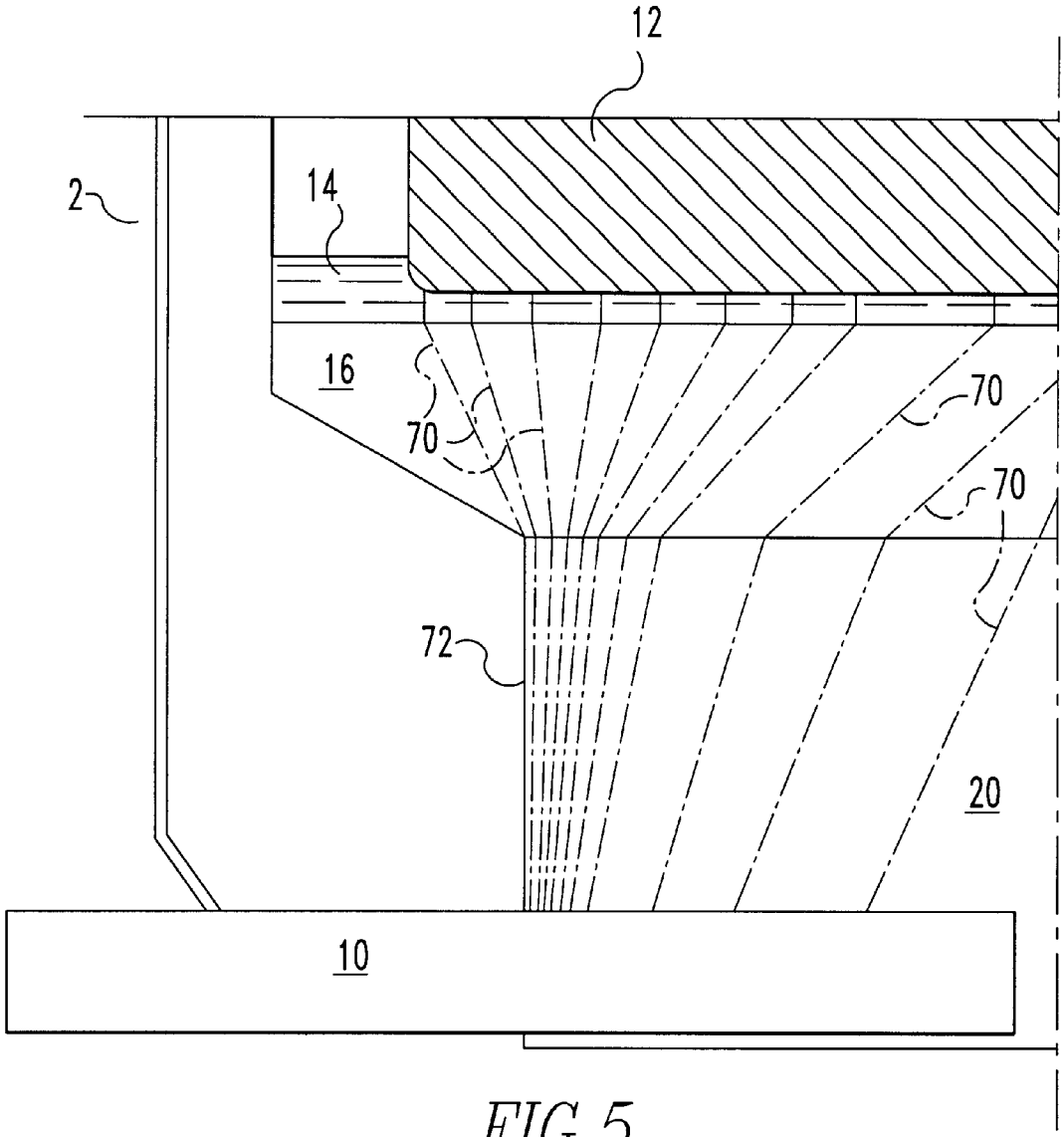
FIG. 5 PRIOR ART
FIG. 5 is a schematic depiction of current paths in a prior art electrolytic cell for aluminum production.

Referring now to FIG. 1, there is shown a prior art electrolytic cell 2 for aluminum production, having a pair of conventional cathode collector bars 10. The collector bars 10 have a rectangular transverse cross-section and they are fabricated from mild steel. Electrical current enters the cell through anodes 12, passes through an electrolytic bath 14, and a molten metal pad 16, and then enters a carbon cathode block 20. Current is carried out of the cell by the cathode collector bars 10. As shown in FIG. 5, electrical current lines 70 are non-uniformly distributed and concentrated more toward ends of the collector bar closest to an external bus bar (not shown).

Figure 2:
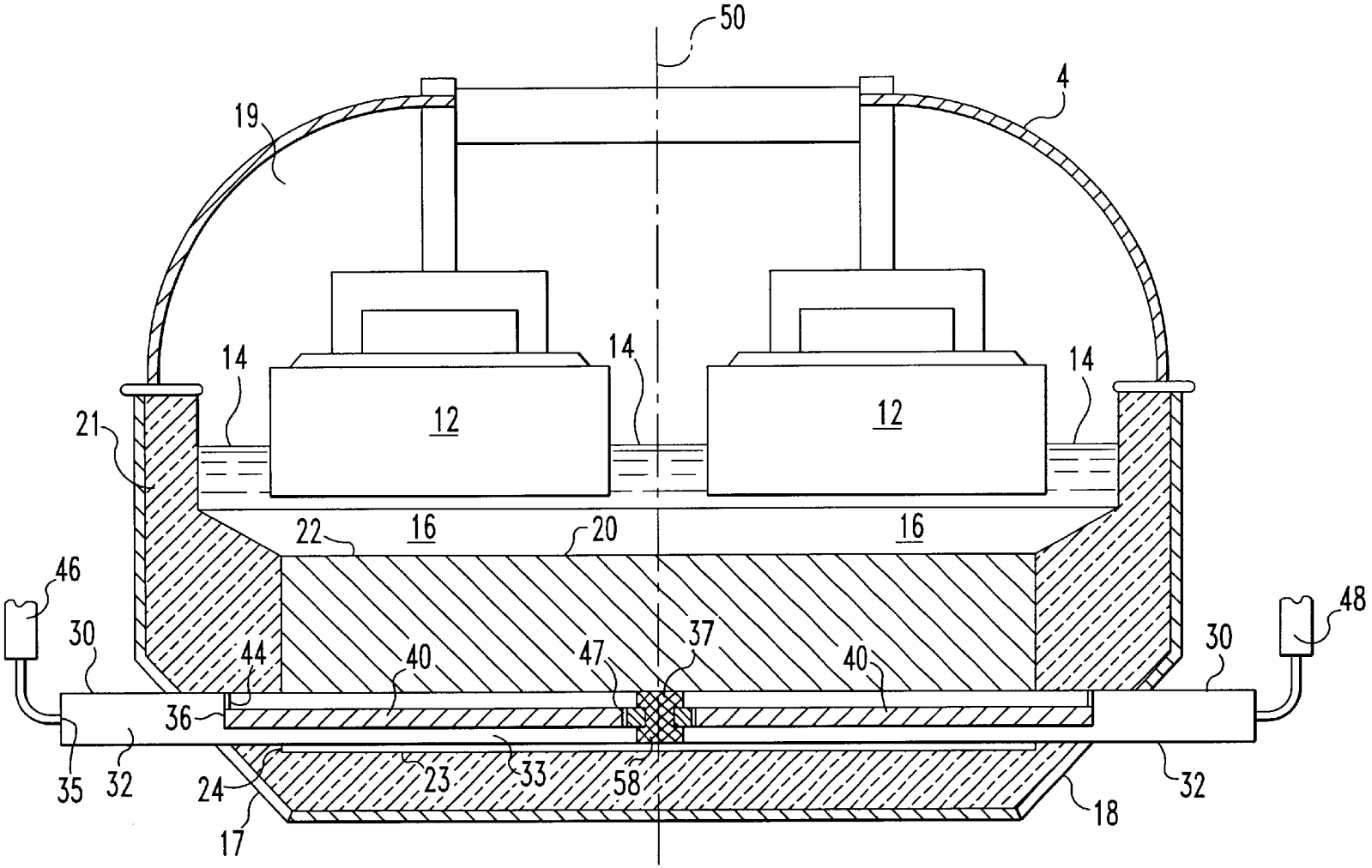
FIG. 2 is a schematic cross-sectional view of an electrolytic cell for aluminum production in accordance with the present invention.

Referring now to FIG. 2, there is shown an electrolytic cell 4 of the present invention. The cell 4 includes a first cell wall 17 and a second wall 18. The cell walls define a chamber 19 lined on its bottom and sides with refractory bricks 21 and containing the molten electrolyte 14. A cathode block 10 has two half-width cathode collector bars 30. Each collector bar 30 extends from a bus bar 46, 48 outside the cell walls 17, 18, and inwardly toward a center line 50. The collector bars 30 are separated by a gap 58 in the middle of the cell filled by a crushable material or by a piece of carbon or by tamped seam mix or by a mixture of such materials. Preferably, the gap 58 is filled by a mixture of materials.

The cathode block 20 has an upper surface 22 supporting the metal pad 16 and a lower surface 23 defining a slot or groove 24 extending between opposed lateral ends of the block 20. The steel collector bars 30 are received in the slot 24 and secured there by a layer of electrically conductive material, preferably cast iron, joining the collector bars 30 to the block 20.

Figure 3:
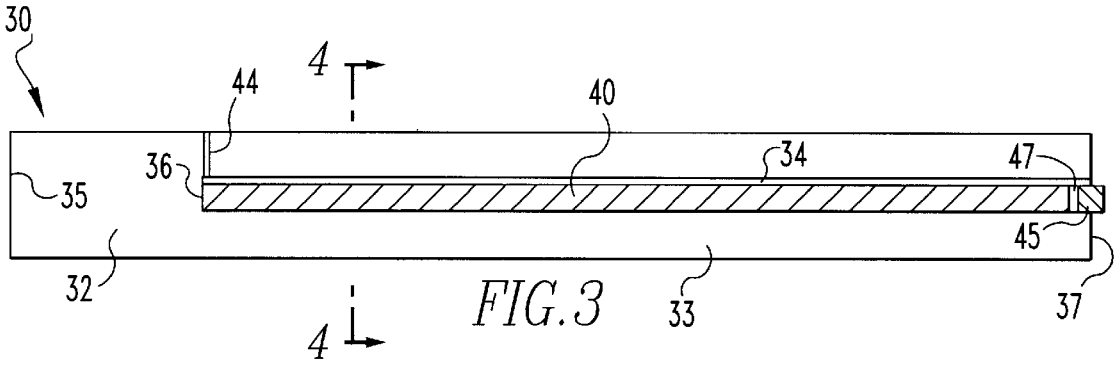
FIG. 3 is a schematic view of a collector bar in the electrolytic cell of FIG. 2.
Figure 4:
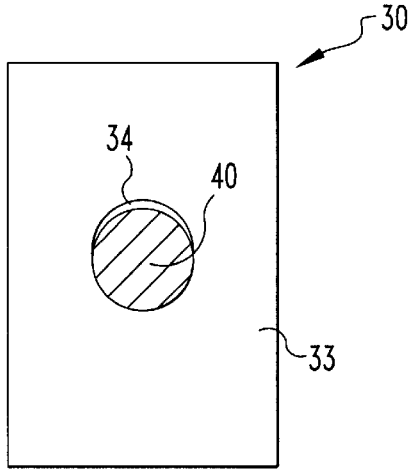
FIG. 4 is a cross-sectional view taken along the lines 4—4 of FIG. 3.

Referring now to FIGS. 2–4, the collector bars 30 each include a ferrous metal body comprising a solid spacer 32 and a sheath 33 defining a cavity 34. Each spacer 32 has an external end portion 35 connected with a bus bar 46 and an internal end portion 36 spaced inwardly of the external end portion 35. Preferably, the internal end portion 36 is inside the cell wall 17, as shown in FIG. 2.

Referring now to FIGS. 3 and 4, a cavity or slot 34 is drilled into an internal side 37 of each collector bar 30. The cavities 34 are machined to have a diameter of about 1.628 inches so that their cross-sectional area is about 2.08 $in^2$, in a collector bar having a transverse cross-sectional area of about 24 $in^2$. The cavities 34 extend longitudinally, between openings in the collector bar internal sides 37 and internal end portions 36 of the spacers 32. The cavities 34 are positioned centrally inside the collector bars 30, to minimize distortion accompanying heating and cooling.

A copper insert 40 comprising a cylindrical rod is placed inside each cavity 34. The copper insert has a diameter of approximately 1.625±0.0025 inches so that its transverse cross-sectional area is about 2.07 $in^2$. For practice of our invention we prefer copper inserts composed of a high conductivity grade of copper containing about 99.95–99.99 wt % copper.

An air vent 44 is drilled into each collector bar, between the cavity 34 and a top side. The air vent 44 vents air from the cavity 34 when the copper insert 40 is positioned inside. After the insert 40 is in place, the vent 44 is filled with refractory mortar. If sufficient pressure develops in the cavity 34 to expel the mortar, the vent 44 provides a path for pressure relief.

A steel plug 45 is placed in the cavity 34 to enclose the copper insert 40. A small space 47 between the plug 45 and the insert 40 allows for expansion upon heating to operating temperature. The plug 45 is welded to the internal side 37 of the collector bar 20. In particularly preferred embodiment, the space 47 provides an expansion allowance of about 0.65 inch and the steel plug 45 has a length of about 1 inch.

The apparatus and method of our invention redirect current in a Hall-Heroult cell to reduce or eliminate inefficiencies attributable to non-uniform electrical currents and horizontal electrical currents.

The cathode current path and current distribution are influenced by the differential between electrical conductivity of the aluminum metal pad and the cathode assembly. With a high electrical conductivity differential in favor of the aluminum pad, the preferred current path will be sideways through the metal pad toward a side wall of the pot and then downwardly through the cathode block to the collector bar.

In FIG. 5 there is shown a current gradient 70 in a prior art pot 2 having an anode 12, a molten metal pad 16, a cathode block 20, and a collector bar 10. The highest current concentration is found directly over the steel collector bar 10 close to an outer end 72 of the cathode block 20. The lowest current distribution is found in the middle of the cathode block 20, adjacent an internal end portion of the collector bar 10. Localized wear patterns observed on the cathode block 20 are deepest in the area of highest electrical current density.

As electrical conductivity of the cathode block 20 increases to reflect a change to higher graphite content or graphitized cathode blocks, the cathode current distribution 70 becomes more concentrated at the outer end 72 of the block. At constant amperage, the localized wear rate will increase near the outer end 72 of the block 20 as the graphite content increases and reaches a maximum for graphitized cathode blocks.

Figure 6:
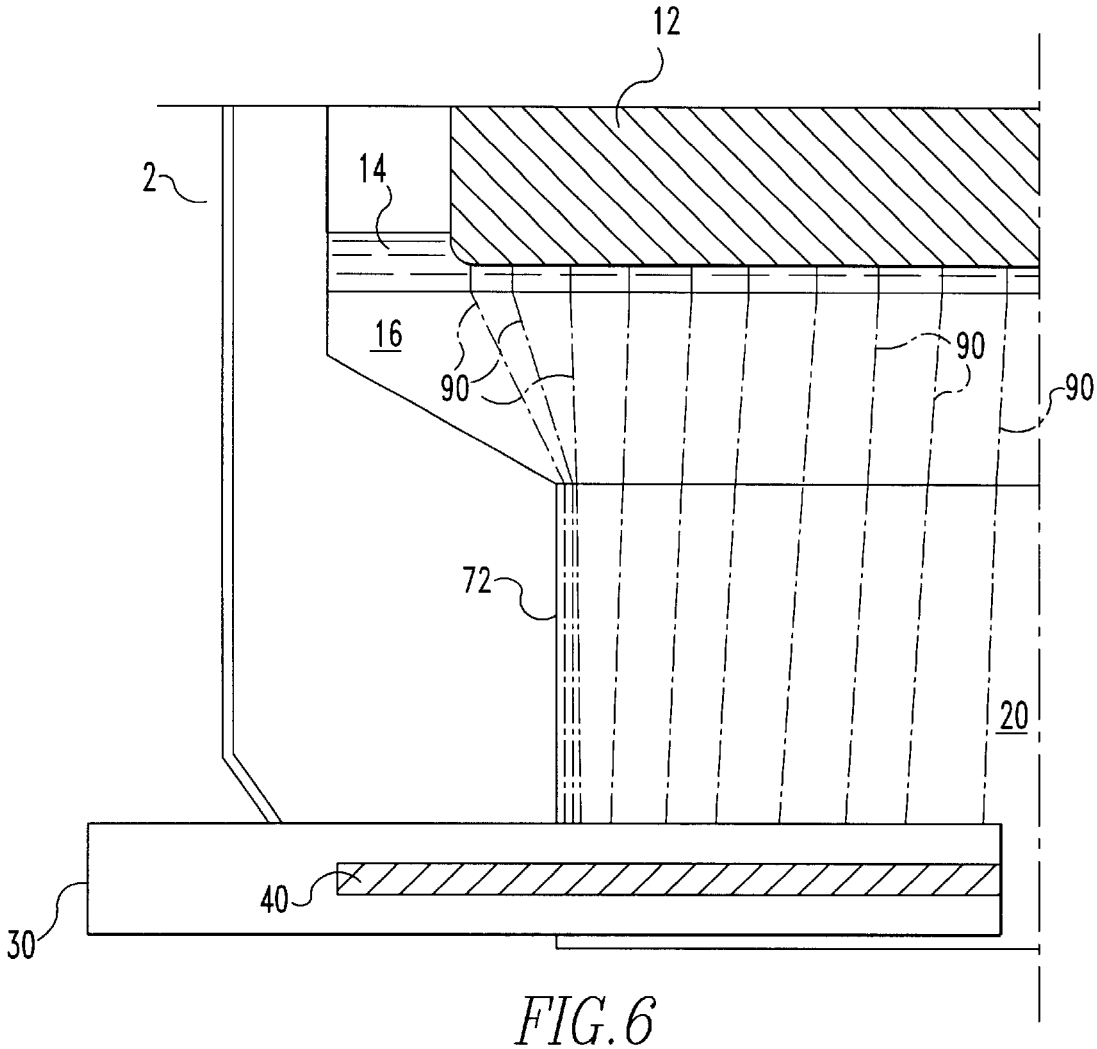
FIG. 6 is a schematic depiction of current paths in an electrolytic cell of the present invention.

The apparatus and method of our invention redirect current in a Hall-Heroult cell to reduce inefficiencies attributable to non-uniform and horizontal electric currents. As shown in FIG. 6, our cell 2 includes an anode 12, molten metal pad 16, cathode block 20, and a collector bar 30 having a copper insert 40. The current gradient 90 extends from the anode 12 to the metal pad 16 and along the entire length of the cathode block 20. The current distribution pattern 90 is more uniform than the pattern 70 shown in FIG. 5. The copper insert 40 increases electrical conductivity of the collector bar 30 by reducing the conductivity differential in favor of the aluminum pad 16, thereby distributing current more evenly across the block 20.

At pot operating temperatures, aluminum has an electrical conductivity of 3,470,000 $(\text{ohm-m})^{-1}$ and steel has an electrical conductivity of 877,800 $(\text{ohm-m})^{-}$. Copper's conductivity of 1,628,000 $(\text{ohm-m})^{-1}$ is considerably higher than steel and aluminum. We have observed that placing a copper insert in a steel collector bar significantly increases its overall electrical conductivity, corresponding to a lower overall resistance in the collector bar. The result is more uniform current distribution in the cathode and reduced localized wear rates.

The cathode voltage drop is also reduced by up to 50 mV. This voltage drop can be utilized to reduce the cost of electrical power at a constant production rate, or to increase the tonnage of aluminum produced at constant power.

Ends of the collector bars extending through side walls of the pot act as fins or heat sinks. Integrating copper inserts into the collector bars increases pot heat losses. Accordingly, the length of the copper insert must be carefully controlled to prevent excessive heat losses and adverse pot life effects. Preferably the copper inserts should not extend outside the pot side walls 17, 18. We also combine the copper insert collector bar with additional insulation material in the pot to offset the extra heat loss caused by the copper insert.

Having thus described the presently preferred embodiments of our invention, it is to be understood that the invention may be otherwise embodied without departing from the spirit and scope of the following claims.

What is claimed is:

1. An electrolytic reduction cell for aluminum production, comprising a cell wall, a bus bar external to said cell wall, an anode, a carbonaceous cathode block separated from said anode, and a collector bar connecting said bus bar with said cathode block, said collector bar comprising:

(a) a ferrous metal body comprising
  1) a solid, ferrous metal spacer having an external end portion connected with said bus bar and an internal end portion spaced inwardly of said external end portion, and
  2) a ferrous metal sheath defining a cavity, and (b) a copper insert inside said cavity, said copper insert having an external end adjacent said spacer.

2. The cell of claim 1 further comprising (c) a molten salt bath between said anode and said cathode block.

3. The cell of claim 1 wherein said cathode block defines a slot and said collector bar is seated in said slot.

4. The cell of claim 3 further comprising (d) means in said slot for joining said collector bar to said cathode block.

5. The cell of claim 4 wherein said means in said slot comprises an electrically conductive material.

6. The cell of claim 4 wherein said means in said slot is selected from the group consisting of cast iron, carbonaceous glue, and rammed carbonaceous paste.

7. The cell of claim 1 wherein said cavity has a polygonal transverse cross-section and said copper insert has a polygonal transverse cross-section.

8. The cell of claim 1 wherein said cavity has a generally circular transverse cross-section and said copper insert has a generally circular transverse cross-section.

9. The cell of claim 1 wherein said cathode block comprises about 30–100 wt % graphite or a graphitized cathode block.

10. The cell of claim 1, wherein said ferrous metal sheath is integral with said spacer.

11. The cell of claim 1, wherein said internal end portion of the spacer is spaced inwardly of said cell wall.

12. The cell of claim 1, further comprising a steel plug enclosing the copper insert in said cavity.

13. The cell of claim 12, further comprising an expansion allowance space in said cavity between the copper insert and the steel plug.

14. The cell of claim 1, wherein said collector bar further defines an air vent for relieving pressure from said cavity.

15. A method for producing aluminum in an electrolytic cell having cell walls defining a chamber containing a molten salt bath, an anode contacting the bath, and a bus bar outside the cell walls, said method comprising:

a) providing a cathode assembly comprising
  1) a carbonaceous cathode block separated from the anode,
  2) a ferrous metal body comprising a solid, ferrous metal spacer having an external end portion connected with said bus bar and an internal end portion spaced inwardly of said external end portion, and a ferrous metal sheath defining a cavity, and
  3) a copper insert inside said cavity, said copper insert having an external end adjacent said spacer, and b) passing an electric current from the anode to the cathode assembly, thereby to produce aluminum in said cell.

16. The method of claim 15, wherein said ferrous metal sheath is integral with said spacer.

17. The method of claim 15, wherein said internal end portion of the spacer is inside said cell walls.

* * * * *